US010806257B1

(12) United States Patent
Liu

(10) Patent No.: US 10,806,257 B1
(45) Date of Patent: Oct. 20, 2020

(54) WIRE SHELVING ASSEMBLY

(71) Applicant: TAIWAN SHIN YEH ENTERPRISE CO., LTD., Chia Yi Hsien (TW)

(72) Inventor: Hung-Tsun Liu, Chiayi (TW)

(73) Assignee: TAIWAN SHIN YEH ENTERPRISE CO., LTD., Chia Yi Hsien (TW)

( * ) Notice: Subject to any disclaimer, the term of this patent is extended or adjusted under 35 U.S.C. 154(b) by 0 days.

(21) Appl. No.: 16/788,723

(22) Filed: Feb. 12, 2020

(51) Int. Cl.

| | |
|---|---|
| ***A47B 96/02*** | (2006.01) |
| ***A47B 47/02*** | (2006.01) |
| ***A47B 57/34*** | (2006.01) |
| *A47B 57/58* | (2006.01) |
| *A47F 5/10* | (2006.01) |
| *A47B 57/40* | (2006.01) |

(52) U.S. Cl.
CPC ..... *A47B 96/021* (2013.01); *A47B 47/024* (2013.01); *A47B 57/34* (2013.01); *A47B 47/021* (2013.01); *A47B 57/40* (2013.01); *A47B 57/58* (2013.01); *A47F 5/101* (2013.01)

(58) Field of Classification Search
CPC ..... A47B 57/402; A47B 57/50; A47B 47/028; A47B 96/021; A47B 47/024; A47B 57/34; A47B 57/58; A47B 57/40; A47B 47/021; A47B 96/06; A47F 5/01
USPC ..... 211/188, 186, 187, 190–192, 194
See application file for complete search history.

(56) References Cited

U.S. PATENT DOCUMENTS 2,918,176 A * 12/1959 Bell ..... A47B 47/028 211/191
3,042,221 A * 7/1962 Rasmussen ..... A47B 57/50 211/183
3,266,635 A * 8/1966 McConnell ..... A47B 57/402 211/191
3,285,428 A * 11/1966 Scheck ..... A47B 57/06 211/191
3,463,325 A * 8/1969 Rogers ..... F16B 12/32 211/191
3,465,895 A * 9/1969 Miller ..... A47B 57/402 211/191
3,647,080 A * 3/1972 Denny ..... A47B 47/027 211/191
3,862,691 A * 1/1975 Mori ..... A47B 57/40 211/191
4,048,059 A * 9/1977 Evans ..... A47B 96/024 108/155
4,078,664 A * 3/1978 McConnell ..... A47B 96/00 108/159
4,261,470 A * 4/1981 Dolan ..... F16B 12/36 108/55.1

(Continued)

*Primary Examiner* — Jonathan Liu
*Assistant Examiner* — Devin K Barnett
(74) *Attorney, Agent, or Firm* — Muncy, Geissler, Olds & Lowe, P.C.

(57) ABSTRACT

A wire shelving assembly includes four legs, a crosspiece unit, and a deck member removably disposed on the crosspiece unit. The crosspiece unit includes two carrying crosspieces and a strengthening crosspiece. Each of the carrying crosspieces removably interconnects two of the legs, has a receiving groove, and is formed with a pair of first through holes. The strengthening crosspiece has two end segments, each of which is removably inserted into the receiving groove of a respective one of the carrying crosspieces, and is formed with two second through holes registered with the first through holes of the respective one of the carrying crosspieces.

7 Claims, 5 Drawing Sheets

(56) References Cited

U.S. PATENT DOCUMENTS 4,382,518 A * 5/1983 Bondoux ..... A47B 57/50 211/192
4,665,838 A * 5/1987 Minshall ..... A47B 47/021 108/157.13
4,928,834 A * 5/1990 Neiman ..... A47B 57/402 211/191
4,955,490 A * 9/1990 Schafer ..... A47B 57/581 211/187
5,011,031 A * 4/1991 Konstant ..... A47B 47/027 211/191
5,189,857 A * 3/1993 Herren ..... E04B 2/58 52/317
5,271,337 A * 12/1993 Kolvites ..... A47B 47/04 108/107
5,628,415 A * 5/1997 Mulholland ..... A47B 47/027 211/186
5,749,481 A * 5/1998 Miller ..... A47B 47/021 211/187
6,260,318 B1 * 7/2001 Herren ..... E04B 2/7453 52/317
D637,427 S * 5/2011 Troyner ..... D6/705.6
8,522,987 B2 * 9/2013 Lim ..... A47B 47/00 211/134
8,695,816 B2 * 4/2014 Troyner ..... A47B 96/14 211/191
8,733,564 B2 * 5/2014 Fitzgerald ..... A47B 96/06 211/191
9,215,926 B1 * 12/2015 Offerman ..... A47B 47/02
9,215,931 B1 * 12/2015 Offerman ..... A47B 96/02
9,375,102 B2 * 6/2016 Troyner ..... A47B 57/402
D777,480 S * 1/2017 Anderson ..... D6/675.2
10,299,593 B2 * 5/2019 Bruckner ..... A47B 47/028
10,299,594 B2 * 5/2019 Liss ..... A47B 96/021
2002/0020684 A1 * 2/2002 Gruber ..... A47B 47/027 211/189
2002/0139766 A1 * 10/2002 Courtwright ..... B65G 1/026 211/191
2002/0195410 A1 * 12/2002 Lin ..... A47B 57/16 211/190
2003/0155319 A1 * 8/2003 Wishart ..... A47F 5/13 211/189
2004/0007550 A1 * 1/2004 Leeman ..... A47F 5/101 211/189
2004/0045921 A1 * 3/2004 Muller ..... A47B 87/005 211/187
2006/0118503 A1 * 6/2006 Patton ..... A47B 95/00 211/187
2006/0157435 A1 * 7/2006 Oberhaus ..... A47F 5/01 211/187
2006/0163185 A1 * 7/2006 Konstant ..... A47B 47/021 211/189
2010/0181274 A1 * 7/2010 Vargo ..... A47B 57/50 211/187
2012/0000871 A1 * 1/2012 Troyner ..... A47B 96/02 211/134
2012/0067838 A1 * 3/2012 Lawson ..... A47B 47/028 211/134
2012/0187065 A1 * 7/2012 Song ..... A47B 55/00 211/191
2014/0116973 A1 * 5/2014 Buckley ..... A47F 5/00 211/134
2014/0353271 A1 * 12/2014 Kruse ..... A47F 5/13 211/188
2015/0090683 A1 * 4/2015 Sabounjian ..... A47B 47/028 211/186
2015/0282613 A1 * 10/2015 Chen ..... A47B 47/021 211/187
2017/0238703 A1 * 8/2017 Tsai ..... A47B 47/0083
2017/0347793 A1 * 12/2017 Wang ..... A47B 47/025

* cited by examiner

WIRE SHELVING ASSEMBLY

FIELD

The disclosure relates to a shelving, and more particularly to a wire shelving assembly that is adjustable.

BACKGROUND

A conventional wire shelving assembly includes four legs, a plurality of crosspieces and a plurality of deck members. The legs are upright and are spaced apart from each other to define a cubic space. The crosspieces are divided into a plurality of pairs. In each pair of the crosspieces, the crosspieces are parallel and horizontally spaced apart from each other, one of the crosspieces is connected between two of the four legs that define a surface of the cubic space, and the other one of the crosspieces is connected between the other two of the four legs. Each of the deck members is supported by a respective pair of the crosspieces for shelving.

SUMMARY

The object of the disclosure is to provide a wire shelving assembly that is adjustable and that has a more stable and sturdy structure.

According to an aspect of the disclosure, a wire shelving assembly includes a leg unit, at least one crosspiece unit and at least one deck member.

The leg unit includes two first legs being upright and spaced apart in a first horizontal direction, and two second legs being upright and spaced apart in the first direction and respectively aligned with the first legs in a second horizontal direction which is perpendicular to the first horizontal direction.

The at least one crosspiece unit includes two carrying crosspieces, at least one strengthening crosspiece and at least one retaining subunit.

The carrying crosspieces extend in the first horizontal direction and are spaced apart in the second direction. One of the carrying crosspieces removably interconnects the first legs, and the other one of the carrying crosspieces removably interconnects the second legs. Each of the carrying crosspieces has a carrying body that defines a receiving groove having a groove opening. The groove openings of the carrying bodies of the carrying crosspieces face each other. Each of the carrying crosspieces is formed with at least one pair of first through holes that are aligned with each other in a vertical direction which is perpendicular to the first and second horizontal directions and that are in spatial communication with the receiving groove. The first through holes of one of the carrying crosspieces are aligned with the first through holes of the other one of the carrying crosspieces in the second horizontal direction.

The at least one strengthening crosspiece extends in the second direction and has two end segments. Each of the end segments is removably inserted into the receiving groove of a respective one of the carrying crosspieces, and is formed with a pair of second through holes that are registered with the first through holes of the respective one of the carrying crosspieces.

The at least one retaining subunit includes two retaining members. Each of the retaining members removably extends through the first through holes of a respective one of the carrying crosspieces and the second through holes of a respective one of the end segments of the at least one strengthening crosspiece.

The at least one deck member is removably disposed on the carrying body of each of the carrying crosspieces of the at least one crosspiece unit.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
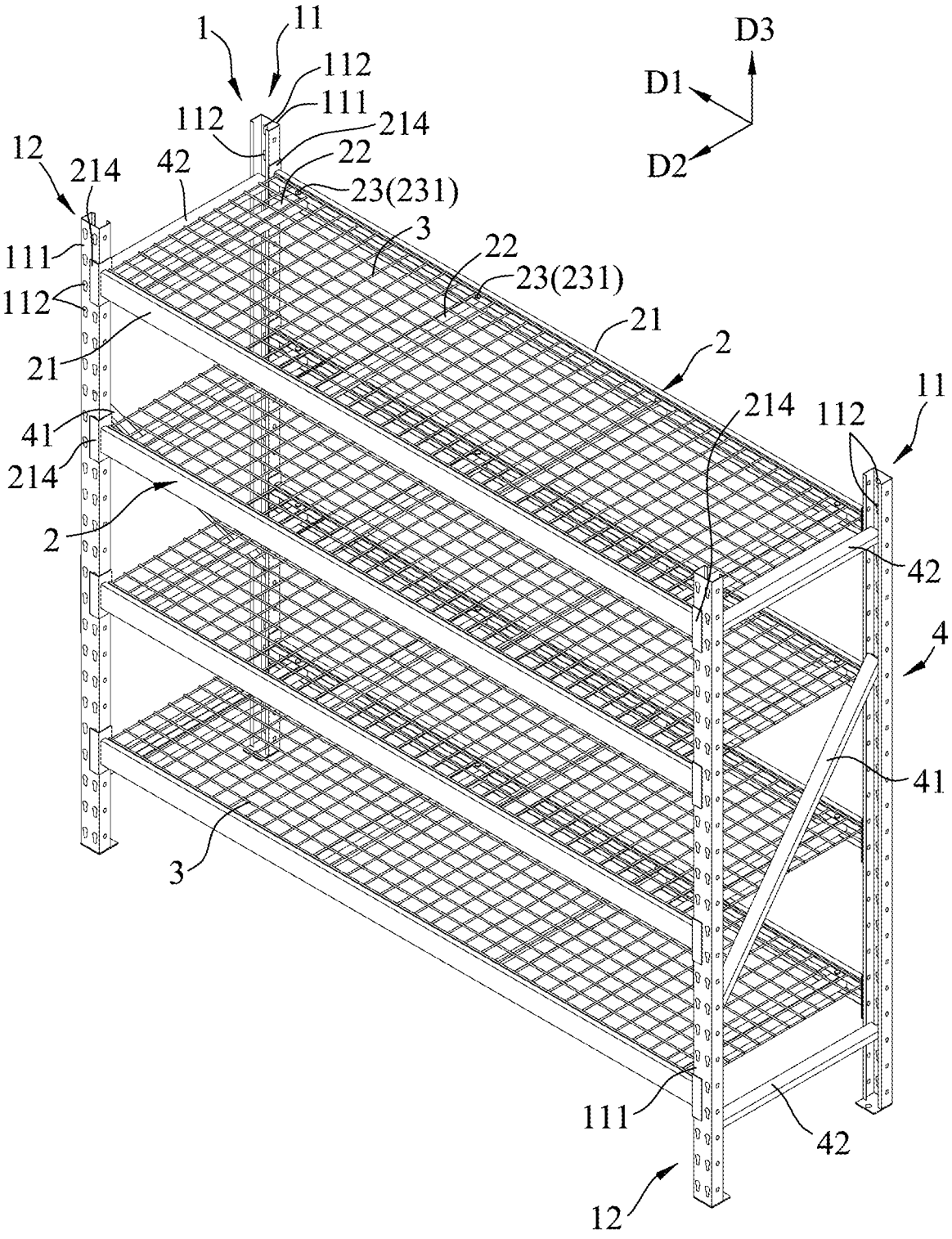
FIG. 1 is an assembled perspective view of an embodiment of wire shelving assembly according to the disclosure.
Figure 2:
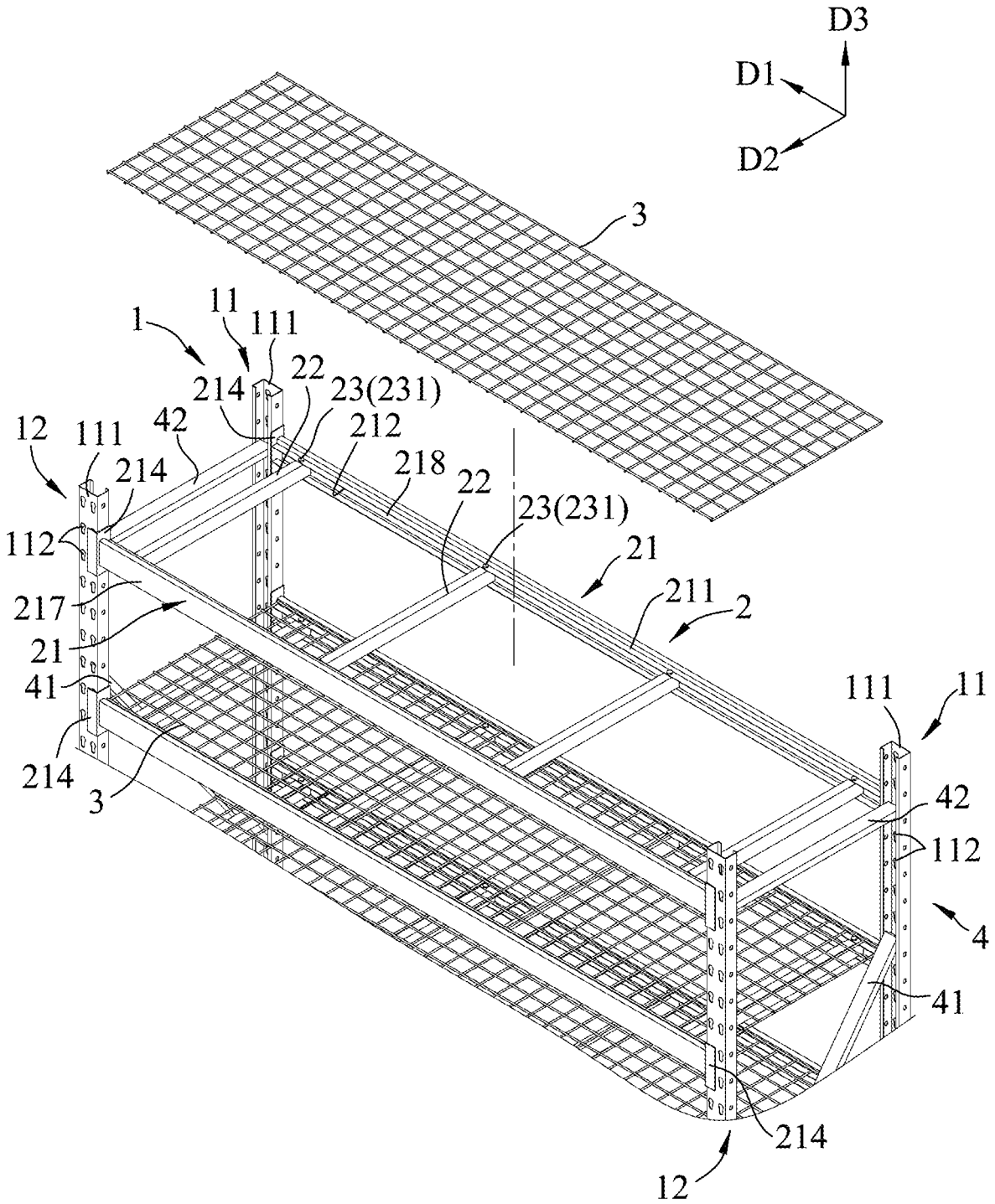
FIG. 2 is a fragmentary and partly-exploded perspective view of the embodiment, illustrating one of a plurality of deck members disassembled from one of a plurality of crosspiece units.

Referring to FIGS. 1 and 2, an embodiment of a wire shelving assembly according to the disclosure includes a leg unit 1, four crosspiece units 2, four deck members 3 and a brace unit 4.

The leg unit 1 includes two first legs 11 that are upright and spaced apart in a first horizontal direction (D1), and two second legs 12 that are upright and spaced apart in the first horizontal direction (D1) and that are respectively aligned with the first legs 11 in a second horizontal direction (D2) which is perpendicular to the first horizontal direction (D1).

Figure 4:
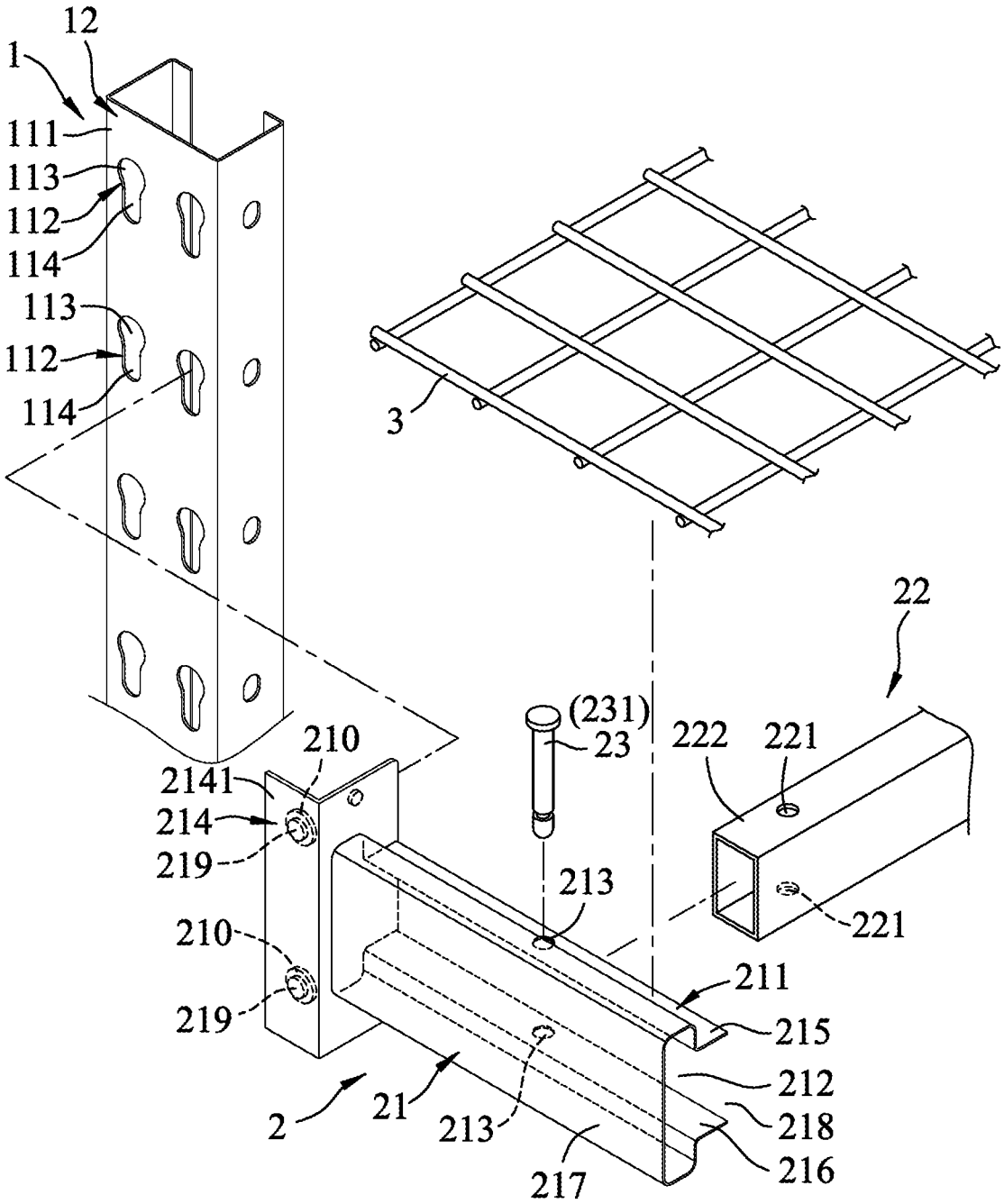
FIG. 4 is a fragmentary exploded perspective view of the embodiment.
Figure 5:
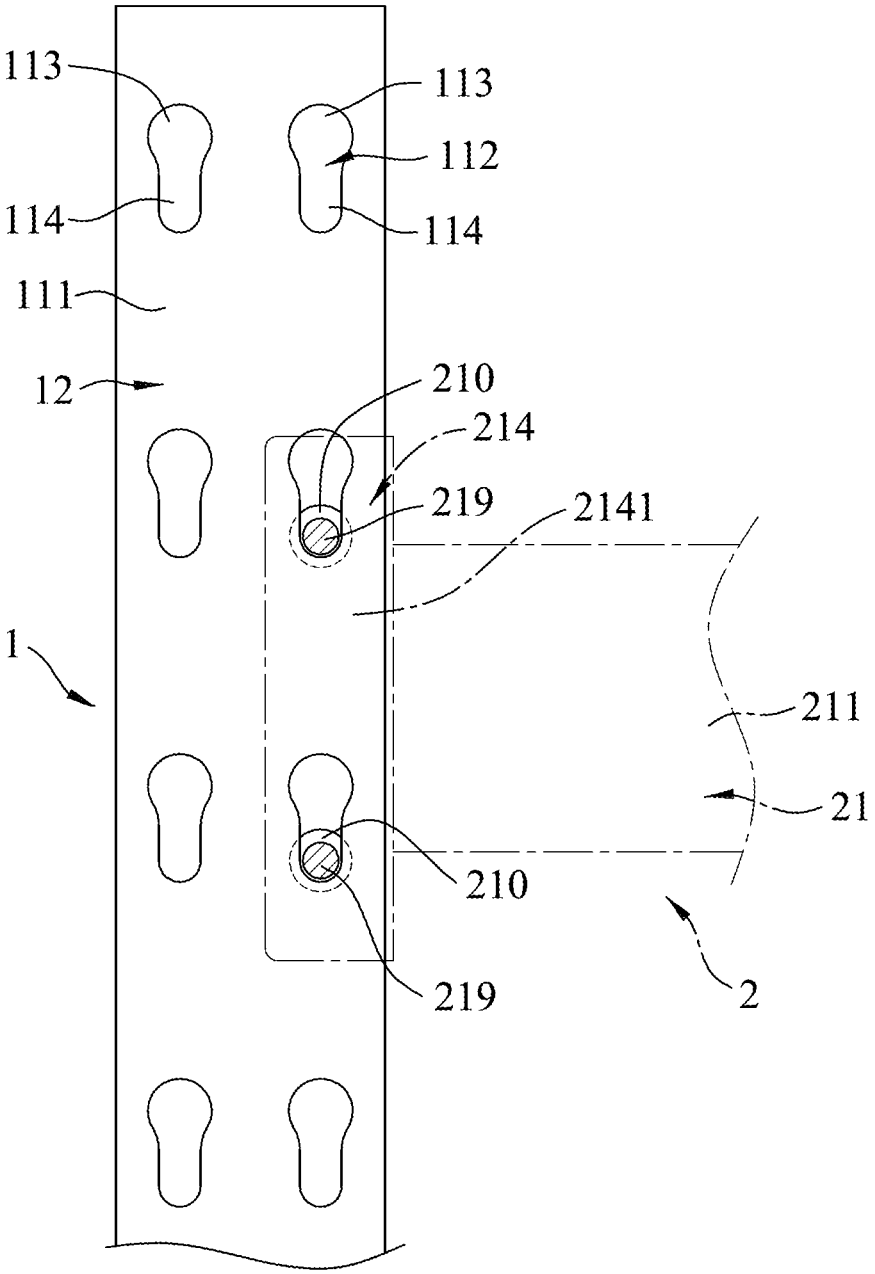
FIG. 5 is a fragmentary side view of the embodiment, illustrating the engagement between the second leg and the carrying crosspiece.

Referring further to FIGS. 4 and 5, each of the first and second legs 11, 12 has a C-shaped cross-section, and has an upright wall 111 and a plurality of connecting portions 112. The connecting portions 112 are arranged in two vertical rows which are spaced apart from each other in the first horizontal direction (D1). In each row, the connecting portions 112 are spaced apart from each other in a vertical direction (D3) that is perpendicular to the first and second horizontal directions (D1, D2).

Each of the connecting portions 112 of the first and second legs 11, 12 is configured as a hole that extends through the upright wall 111. Each of the holes of the connecting portions 112 has an upper larger hole region 113 and a lower smaller hole region 114 that extends downwardly from the upper larger hole region 113 in the vertical direction (D3).

Figure 3:
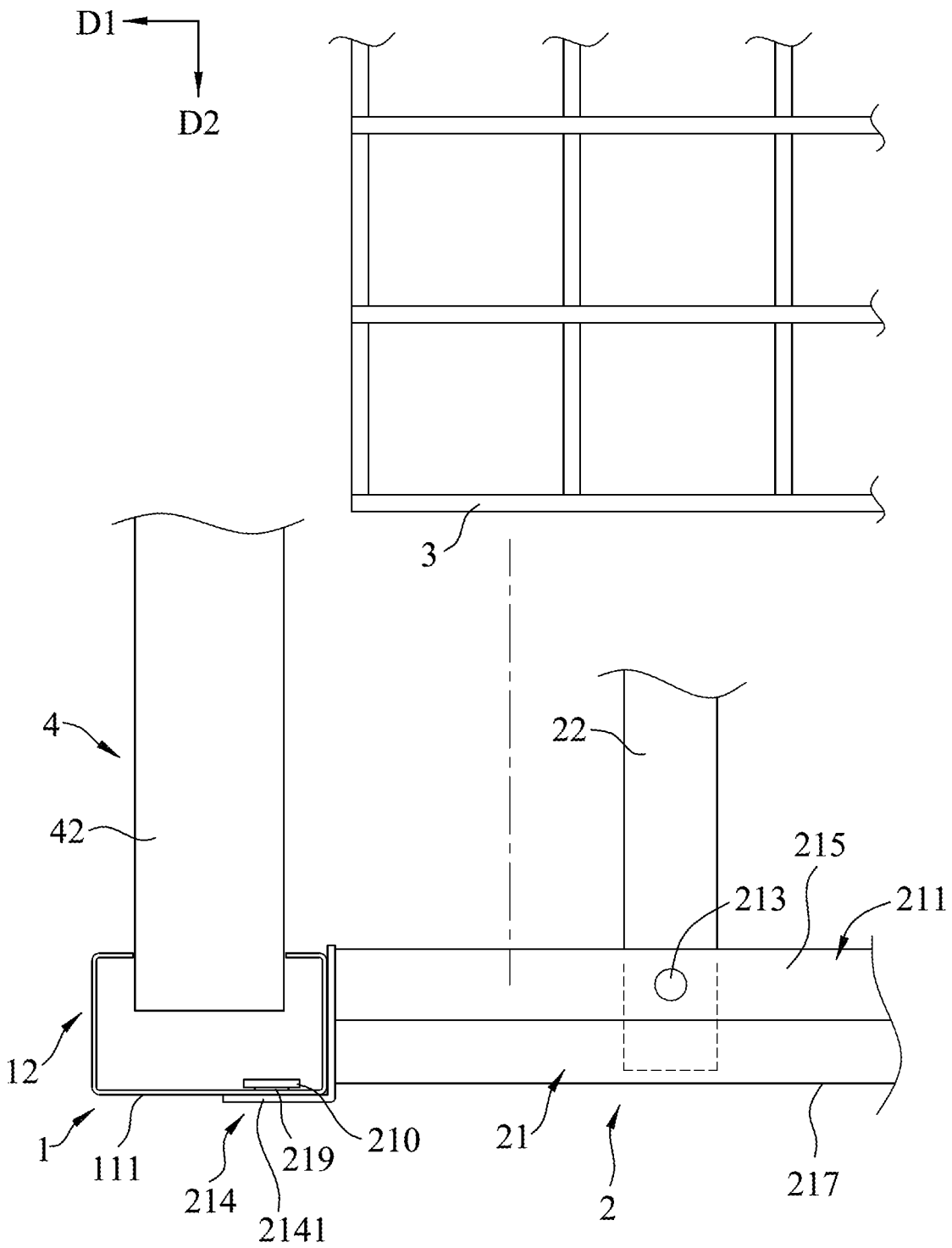
FIG. 3 is a fragmentary and partly-exploded top view of the embodiment, illustrating engagement between a second leg and a carrying crosspiece of one of the crosspiece units, and engagement between the carrying crosspiece and a strengthening crosspiece of the one of the crosspiece units.

Referring to FIGS. 2 to 4, the crosspiece units 2 are spaced apart in the vertical direction (D3) and are mounted to the leg unit 1. In the present embodiment, each of the crosspiece units 2 and a respective one of the deck members 3 cooperatively form a tier structure; that is, the present embodiment includes four tier structures (see FIG. 1). Since the tier structures are substantially identical and are mounted to the leg unit 1 in the same manner, only one of the tier structures is described in details as follows for the sake of brevity.

Accordingly, for each of the tier structures, the crosspiece unit 2 includes two carrying crosspieces 21, four strengthening crosspieces 22 and four retaining subunits 23.

The carrying crosspieces 21 extend in the first horizontal direction (D1) and are spaced apart in the second horizontal direction (D2). Each of the carrying crosspieces 21 removably interconnects two corresponding ones of the first and second legs 11, 12; specifically, one of the carrying crosspieces 21 is connected between the first legs 11, and the other one is connected between the second legs 12.

Each of the carrying crosspieces 21 has a carrying body 211 and two engaging portions 214, and is formed with four pairs of first through holes 213 (only one pair of the first through holes 213 are shown in FIG. 4).

As shown in FIGS. 2 and 4, the carrying body 211 of each of the carrying crosspieces 21 defines a receiving groove 212 that has a groove opening 218. For each of the tier structures, the groove openings 218 of the carrying crosspieces 21 face each other.

Specifically, the carrying body 211 of each of the carrying crosspieces 21 has a top flange 215, a bottom flange 216 opposite to the top flange 215 in the vertical direction (D3), and a web 217 transversely connected between the top and bottom flanges 215, 216 in a manner that the carrying body 211 has a C-shaped cross-section (see FIG. 2). The top flange 215, the bottom flange 216 and the web 217 of the carrying body 211 of each of the carrying crosspieces 21 cooperatively define the receiving groove 212.

Each of the first through holes 213 of the carrying cross pieces 21 is round, has a diameter smaller than widths of the top and bottom flanges 215, 216 in the second horizontal direction (D2), and extends through a corresponding one of the top and bottom flanges 215, 216. For the carrying body 211 of each of the carrying crosspieces 21, the four pairs of the first through holes 213 are spaced apart from each other in the first horizontal direction (D1). In each pair, the first through holes 213 are aligned with each other in the vertical direction (D3) and are in spatial communication with said receiving groove 212. For each of the tier structures, the first through holes 213 of one of the carrying crosspieces 21 are aligned respectively with the first through holes 213 of the other one of the carrying crosspieces 21 in the second horizontal direction (D2).

Referring to FIG. 5 in conjunction with FIGS. 2 and 4, for each of the carrying crosspieces 21, the engaging portions 214 are opposite to each other in the first horizontal direction (D1), and are connected respectively to opposite ends of the carrying body 211; each of the engaging portions 214 is detachably connected to a respective one of the two corresponding ones of the first and second legs 11, 12.

Specifically, the engaging portion 214 detachably engages adjacent two of the connecting portions that are disposed in the same row and that are immediately adjacent to each other in the vertical direction (D3). In this embodiment, each of the engaging portions 214 has a linking body 2141, and two engaging pins each including a neck 219 and an enlarged head 210.

For each of the engaging portions 214, the linking body 2141 has an L-shaped horizontal cross-section, and has a first plate connected to the the carrying body 211 and a second plate in contact with a surface of the respective one of the first and second legs 11, 12 where the connecting portions 112 are disposed; the necks 219 of the engaging pins extend from the linking body 2141, and extend removably and respectively through the lower smaller hole regions 114 of the adjacent two of the connecting portions 112; the enlarged heads 210 of the engaging pins are connected respectively to the necks 219. Each of the enlarged heads 210 has a maximum cross-section that is larger than the lower smaller hole region 114 and that is smaller than the upper larger hole region 113 of each of the connecting portions 112.

Each of the strengthening crosspieces 22 of the crosspiece unit 2 of each of the tier structures extends in the second horizontal direction (D2) and has two end segments 222. For each of the strengthening crosspieces 22, each of the end segments 222 is removably inserted into the receiving groove 212 of a respective one of the carrying crosspieces 21 of the crosspiece unit 2, and is formed with two second through holes 221 that are aligned with each other in the vertical direction (D3), that are round, and that are registered respectively with a respective pair of the first through holes 213 of the respective one of the carrying crosspieces 21. In other words, for the crosspiece unit 2 of each of the tier structures and for each of the strengthening crosspieces 22, two pairs of the second through holes 221 formed respectively on the end segments 222 of the strengthening crosspiece 22 are registered respectively with two pairs of the first through holes 213 that are aligned in the second horizontal direction (D2).

It should be noted that, in the present embodiment, each of the strengthening crosspieces 22 has a quadrilateral cross-section, and is hollow; however, the strengthening crosspieces 22 may be solid in other embodiments of the disclosure.

Each of the retaining subunits 23 includes two retaining members 231 (i.e. each of the tier structures has eight retaining members 231). In the present embodiment, the retaining members 231 are joint pins.

For the crosspiece unit 2 of each of the tier structures, each of the retaining members 231 removably extends through a respective pair of the first through holes 213 of the carrying crosspieces 21, and a respective pair of the second through holes 221 of the strengthening crosspieces 22 that is registered with the respective pair of the first through holes 213.

The deck members 3 of the present embodiment are rectangular. For each of the tier structures, the deck member 3 is removably disposed on the carrying body 211 of each of the carrying crosspieces 21 of the crosspiece unit 2.

Referring again to FIG. 1, the brace unit 4 of the present embodiment includes two first braces 41 and four second braces 42 that are welded to the leg unit 1.

Each of the first braces 41 is inclined relative to the first and second legs 11, 12, and has opposite ends. One end of each of the first braces 41 is connected to a respective one of the first legs 11, and the other end is connected to a respective one of the second legs 12 that is aligned with the respective one of the first legs 11 in the second horizontal direction (D2).

The second braces 42 extend in the second horizontal direction (D2). Each of the second braces 42 is connected between a corresponding one of the first legs 11 and a corresponding one of the second legs 12 that is aligned with the corresponding one of the first legs 11 in the second horizontal direction (D2) in a manner that, two of the second braces 42 are disposed respectively above the first braces 41, and the other two are disposed respectively under the first braces 41. The first and second braces 41, 42 that are connected between the same corresponding first and second legs 11, 12 (i.e. the first and second braces 41, 42 that are at the same side of the wire shelving assembly) cooperatively form a Z-shaped structure which provides a strong support and helps distribute stress evenly for the wire shelving assembly.

It should be noted that, with regard to mounting the crosspiece units 2 to the leg unit 1, an imaginary plane defined by the carrying crosspieces 21 of each of the crosspiece units 2 does not overlap any of ends of the first braces 41 and any of the second braces 42; in such a manner, the brace unit 4 does not obstruct connections between the crosspiece units 2 and the leg unit 1.

To assemble the wire shelving assembly of the present embodiment, a user connects each of the carrying crosspieces 21 of the crosspiece units 2 horizontally between two corresponding ones of the first and second legs 11,12 of the leg unit 1 by engaging respectively the engaging portions 214 of each of the carrying crosspieces 21 with corresponding ones of the connecting portions 112 of the corresponding first and second legs 11,12. Specifically, for each of the engaging portions 214 of the carrying crosspieces 21, the engaging pins extend respectively into the upper larger hole regions 113 of adjacent two of the connecting portions 112 of the corresponding one of the first and second legs 11, 12; then, the necks 219 and the enlarged heads 210 are slightly lowered such that the necks 219 are received respectively in the lower smaller hole regions 114 of the adjacent two of the connecting portions 112 of the corresponding one of the first and second legs 11, 12. Since the maximum cross-section of each of the enlarged heads 210 of the engaging portions 124 is larger than the respective one of the lower smaller hole regions 114, the enlarged heads 210 of the engaging portions 124 cannot pass through the respective lower smaller hole regions 114 of the connecting portions 112 in the second horizontal direction (D2). Thus, the carrying crosspieces 21 of the crosspiece units 2 are securely mounted to the leg unit 1.

Next, each of the strengthening crosspieces 22 of the crosspieces units 2 is disposed between two corresponding ones of the carrying crosspieces 21. Specifically, the end segments 222 of each of the strengthening crosspieces 22 are inserted respectively into the receiving grooves 212 of the corresponding ones of the carrying cross pieces 21, such that, for each of the strengthening crosspieces 22, two pairs of the second through holes 221 are registered respectively with two pairs of the first through holes 213 of the two corresponding ones of the carrying crosspieces 21. Then, each the retaining members 231 of the retaining subunits 23 extends through a respective pair of the first through holes 213, and a respective pair of the second through holes 221 that is registered with the respective pair of the first through holes 213.

Finally, each of the deck members 3 is disposed on a respective one of the crosspiece units 2, and the assembly process is completed.

It should be noted that, for each of the tier structures of the wire shelving assembly of the present embodiment, the number of the pairs of the first through holes 213 is eight (i.e., each of the carrying crosspieces 21 is formed with four pairs of the first through holes 213); the number of the strengthening crosspieces 22 is four; and the number of the retaining members 231 is eight. However, the numbers may vary in other embodiments of the disclosure. For example, the number of pairs of the first through holes 213, the number of the strengthening crosspieces 22, and the number of the retaining members 231 may be two, one and two, respectively, or ten, five and ten, respectively.

Moreover, in the present embodiment, the number of the crosspiece units 2 is four; however, it may be three or five in other embodiments of the disclosure, depending on actual needs.

It should also be noted that, since the connecting portions 112 of each of the first and second legs 11, 12 are arranged in two rows that are spaced apart in the first horizontal direction (D1), both sides of each of the first and second legs 11, 12 that are opposite in the first horizontal direction (D1) are allowed to be connected with the crosspiece units 2. Thus, the user may expand the structure of the wire shelving assembly in the first horizontal direction (D1). For example, in other embodiments, the leg unit 1 may include three first legs 11 that are spaced apart in the first directions (D1), and three second legs 12 that are aligned respectively with the first legs 11 in the second horizontal direction (D2), and each of the crosspiece units 2 is mounted to four corresponding ones of the first and second legs 11, 12.

In addition, in the case of the example above, any two of the crosspiece units 2 that are mounted at opposite sides of the middle one of the first legs 11 (or the middle one of the second legs 12) in the first direction (D1) may or may not be leveled with each other, such that the user may adjust a height of each of the crosspiece units 2 as needed.

In sum, the wire shelving assembly of the present embodiment according to the disclosure has advantages as follows.

Firstly, the first through holes 213 of the carrying crosspieces 21 and the second through holes 221 of the strengthening crosspieces 22 are less destructive to structures of the carrying crosspieces 21 and the strengthening crosspieces 22. Also, cooperatively, the first through holes 213 of the carrying crosspieces 21, the second through holes 221 of the strengthening crosspieces 22, and the retaining members 23 provide a secured, stable, yet adjustable connection between the leg unit 1 and the crosspiece units 2.

Secondly, in virtue of configuration of the brace unit 4, the present embodiment is more sturdy in comparison with the prior art, as it is provided with more structural support.

Finally, in virtue of configuration of the connecting portions 112 of the first and second legs 11, 12, the present embodiment provides the flexibility and convenience for the user to expand the structure of the wire shelving assembly as needed by connecting more first and second legs 11, 12 and more crosspiece units 2 together.

In the description above, for the purposes of explanation, numerous specific details have been set forth in order to provide a thorough understanding of the embodiment. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A wire shelving assembly comprising:

a leg unit that includes two first legs being upright and spaced apart in a first horizontal direction, and two second legs being upright and spaced apart in the first horizontal direction and respectively aligned with said first legs in a second horizontal direction which is perpendicular to the first horizontal direction;

at least one crosspiece unit that includes two carrying crosspieces extending in the first horizontal direction and spaced apart in the second horizontal direction, a first carrying crosspiece from said carrying crosspieces removably interconnecting said first legs, a second carrying crosspiece from said carrying crosspieces removably interconnecting said second legs, each of said carrying crosspieces having a carrying body that defines a receiving groove having a groove opening, said groove openings of said carrying bodies of said carrying crosspieces facing each other, each of said carrying crosspieces being formed with at least one pair of first through holes that are aligned with each other in a vertical direction which is perpendicular to the first and second horizontal directions and that are in spatial communication with said receiving groove, said at least one pair of first through holes of the first carrying crosspiece from said carrying crosspieces being aligned with said at least one pair of first through holes of the second crosspiece from said carrying crosspieces in the second horizontal direction, each carrying body further comprises a stepped top flange having an upper horizontal top flange portion, a lower horizontal top flange portion below the upper horizontal top flange portion, and a first vertical portion between the upper horizontal top flange portion and the lower horizontal top flange portion;

a stepped bottom flange having an upper horizontal bottom flange portion, a lower horizontal bottom flange portion below the upper horizontal bottom flange portion, and a second vertical portion between the upper horizontal bottom flange portion and the lower horizontal bottom flange portion;

wherein the stepped bottom flange is opposite to said stepped top flange; and a vertical wall transversely connected between said top stepped flange and said stepped bottom flange and cooperating with said stepped top and bottom flanges to define said receiving groove, each pair of first through holes of each carrying crosspiece extending respectively through said lower horizontal top flange portion of the stepped top flange and said upper horizontal bottom flange portion of said stepped bottom flange;

at least one strengthening crosspiece extending in the second horizontal direction and having a rectangular cross-section and two end segments, each of said end segments being removably inserted into said receiving groove of each carrying crosspiece respectively, and being formed with a pair of second through holes that are vertically aligned with a corresponding pair of first through holes of each carrying crosspiece respectively, and at least one retaining subunit including two retaining members, each of said retaining members removably extending through said corresponding pairs of first through holes of said carrying crosspieces and said second through holes of said at least one strengthening crosspiece; and at least one deck member that is removably disposed on said carrying body of each of said carrying crosspieces of said at least one crosspiece unit.

2. The wire shelving assembly as claimed in claim 1, wherein said at least one crosspiece unit includes a plurality of crosspiece units that are spaced apart vertically.

3. The wire shelving assembly as claimed in claim 1, wherein:

each of said first and second legs has an upright wall and a plurality of connecting portions that are arranged vertically along each upright wall and that are spaced apart from each other; and each of said carrying crosspieces further has two engaging portions that are connected respectively to opposite ends of each carrying body, each of said engaging portions detachably engaging at least one of said connecting portions of a respective one of said two corresponding ones of said first and second legs.

4. The wire shelving assembly as claimed in claim 3, wherein said connecting portions of each of said first and second legs are arranged in two vertical rows that are spaced apart from each other in the first horizontal direction.

5. The wire shelving assembly as claimed in claim 3, wherein:

for each of said first and second legs, each of said connecting portions is configured as a hole extending through said upright wall, and has an upper larger hole region, and a lower smaller hole region that extends downwardly from said upper larger hole region; and each of said engaging portions of said carrying crosspieces has a neck that removably extends through said lower smaller hole region of said at least one of said connecting portions of the respective one of said two corresponding ones of said first and second legs, and an enlarged head that is connected to said neck and that has a maximum cross-section being larger than said lower smaller hole region of said at least one of said connecting portions and being smaller than said upper larger hole region of said at least one of said connecting portions.

6. The wire shelving assembly as claimed in claim 1, further comprising a brace unit that includes two first braces, each of said first braces being inclined relative to said first and second legs, and having one end connected to a respective one of said first legs and the other end connected to a respective one of said second legs that is aligned with said respective one of said first legs in the second horizontal direction, wherein an imaginary plane defined by said carrying crosspieces of said at least one crosspiece unit does not overlap said ends of each of said first braces.

7. The wire shelving assembly as claimed in claim 6, wherein:

said brace unit further includes two second braces, each of said second braces extending in the second horizontal direction and connected between a respective one of said first legs and a respective one of said second legs; and the imaginary plane defined by said carrying crosspieces of said at least one crosspiece unit does not overlap each of said second braces.

* * * * *